US006140932A

United States Patent [19]

Frank et al.

[11] Patent Number: 6,140,932

[45] Date of Patent: Oct. 31, 2000

[54] PICTORIALLY ADORNED DRINKING CONTAINER HAVING INTEGRAL AUDIO PLAYBACK

[75] Inventors: Marshall P. Frank; Leslie J. Isralow, both of Aptos, Calif.

[73] Assignee: CrunchTime, Inc., Aptos, Calif.

[21] Appl. No.: 09/319,109

[22] PCT Filed: Dec. 10, 1997

[86] PCT No.: PCT/US97/22747

§ 371 Date: Jul. 7, 1999

§ 102(e) Date: Jul. 7, 1999

[87] PCT Pub. No.: WO98/25828

PCT Pub. Date: Jun. 18, 1998

Related U.S. Application Data

[60] Provisional application No. 60/032,320, Dec. 10, 1996.

[51] Int. Cl.[7] ..... G08B 25/08

[52] U.S. Cl. ..... 340/692; 340/384.1; 340/693.5; 206/217

[58] Field of Search ..... 340/692, 384.1, 340/686.1, 687, 689, 693.12, 693.9, 693.5; 206/217

[56] References Cited

U.S. PATENT DOCUMENTS

| | | | |
|---|---|---|---|
| 4,765,465 | 8/1988 | Yamada et al. | 206/217 |
| 4,932,542 | 6/1990 | Chen et al. | 215/1 R |
| 5,070,539 | 12/1991 | Cheng | 455/344 |
| 5,339,548 | 8/1994 | Russell | 40/324 |
| 5,439,103 | 8/1995 | Howes | 206/217 |
| 5,485,504 | 1/1996 | Ohnsorge | 379/58 |
| 5,489,893 | 2/1996 | Jo et al. | 340/686 |
| 5,536,196 | 7/1996 | Sternberg | 446/81 |
| 5,550,754 | 8/1996 | McNelley et al. | 364/514 A |
| 5,553,735 | 9/1996 | Kimura | 220/469 |
| 5,664,745 | 9/1997 | Hadaway | 248/105 |
| 5,739,758 | 4/1998 | Driska et al. | 340/692 |

*Primary Examiner*—Daniel J. Wu
*Assistant Examiner*—Sihong Huang
*Attorney, Agent, or Firm*—Claude A. S. Hamrick; Oppenheimer, Wolfe & Donnelly, LLP

[57] ABSTRACT

Pictorially adorned drinking container (10) having integral audio playback, including a two-part structure with an upper part forming a drinking cup (12) and a lower or base part forming a chamber (16) for containing electronically recorded data (38) and means for using the data (18) to generate an audible message and/or music segment. The two parts are removably connected together to form a single unit. Affixed to the exterior of the unit by painting, silk-screening or other graphics replication process is the depiction f a memorable sports event or the related to the depicted event and an electronic mechanism which, upon user actuation (54, 48), plays back (50) the sound track so as to enable the cup user to relive the experience or event depicted (60).

21 Claims, 2 Drawing Sheets

PICTORIALLY ADORNED DRINKING CONTAINER HAVING INTEGRAL AUDIO PLAYBACK

This application claims the benefit of U.S. Provisional Application No. 60/032,320, filed Dec. 10, 1996 and International Application No. PCT/US97/22747, filed Dec. 10, 1997, entitled "Pictorially Adorned Drinking Container Having Integral Audio Playback".

BACKGROUND OF THE INVENTION

1. Field of the Invention

The present invention relates generally to novelty drinking container, and more particularly to a drinking container adapted to display pictorial ornamentation and have related sound playback capability.

2. Description of the Prior Art

Numerous types of liquid containers, cups, mugs, glasses, steins, chalices, etc. are known in the art. Such containers are often decorated or otherwise configured to resemble or portray action events such as sporting events or other entertainment happenings such as concerts, symposiums, conferences, and so forth. However, to Applicant's knowledge, no such containers have heretofore included the capability of playing back pre-recorded audio sound directly related to the container ornamentation.

SUMMARY OF THE INVENTION

It is therefore an object of the present invention to provide an improved drinking vessel which, in addition to displaying visually pleasing graphics, also includes pre-recorded audio playback capability intended to re-enforce the enjoyment of the graphics depicted on the container.

Briefly, a preferred embodiment of the present invention includes a two-part structure with an upper part forming a drinking cup and a lower or base part forming a chamber for containing electronically recorded data and means for using the recorded data to generate an audible message and/or music segment. The two parts are removably connected together to form a single unit. Affixed to the exterior of the unit by direct attachment, modeling, molding, painting, silk-screening or other graphics replication process is the depiction of a memorable sports event or the like, forming artistic decoration for the cup. Pre-recorded and stored in electronic form within the base component is a sound track related to the depicted event and an electronic mechanism which, upon user actuation, plays back or otherwise regenerating the sound track so as to enable the cup user to relive the experience or event depicted.

IN THE DRAWING

IN THE SPECIFICATION

Figure 1:
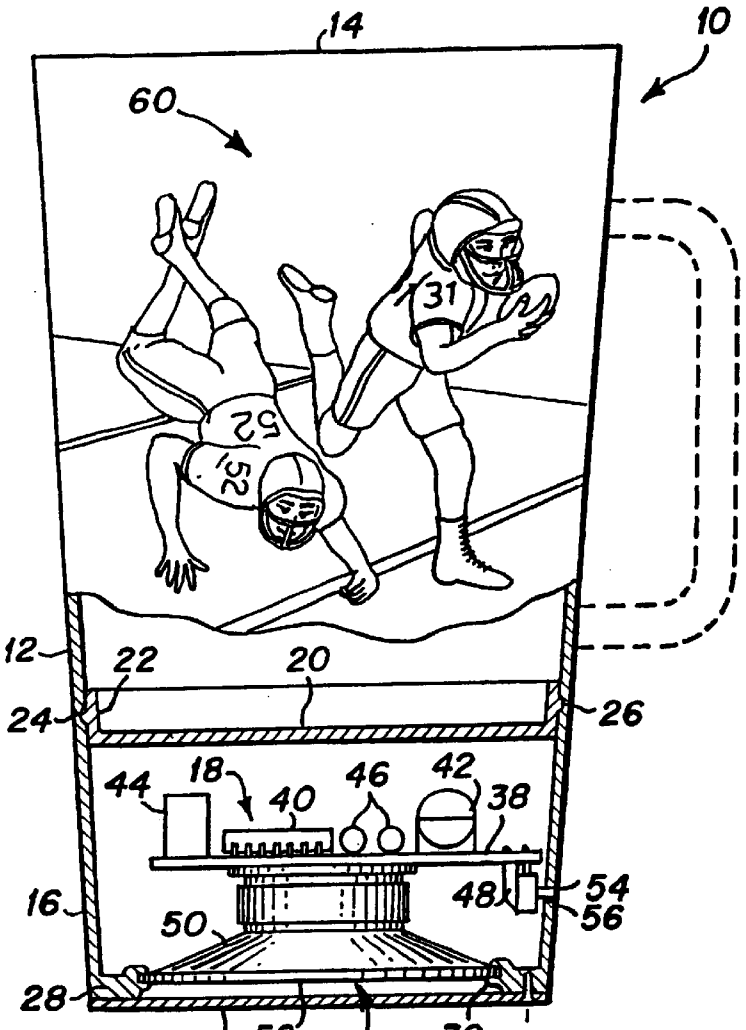
FIG. 1 is a partially broken elevational view illustrating certain details of a preferred embodiment of the present invention.

Referring now to FIG. 1 of the drawing, there is shown at 10 an elevational view of a drinking cup assembly in accordance with a preferred embodiment of the present invention broken apart at a lower portion to illustrate certain electrical and mechanical details thereof. The cup assembly is comprised of an upper component 12 forming a liquid vessel or container that is open at the top 14, and a lower component 16 forming a closed chamber for housing an electronic sound playback subassembly 18.

The upper component 12 is essentially a frusto-conically configured, open-top liquid container closed at the bottom by a circular web 20 molded integral with the side walls 12. A vertically extending segment of the lowermost extremity of the upper component is reduced in diameter, as indicated at 22, and is provided with an external circumscribing rib 24.

The lower component 16 is also generally frusto-conical in configuration with a cone angle matching that of the upper component 12. The diameter of the upper extremity is chosen to match that of the diametrically reduced lower portion of component 12 and includes an internal groove 26 for receiving the annular rib 24 when the upper extremity of component 16 is mated with the lower extremity of component 12. This "snap-on" engagement secures the lower component 16 to the upper component 12. The lower extremity of component 16 includes a thickened annulus 28 defining and circumscribing a circular opening 30 and having a circular groove 32 formed therein. The opening 30 is closed by a circular plate 34 which is secured to the annulus 28 by means of a plurality of small screws 36 or other suitable fastening means.

The upper cup component 12, the lower sound assembly component 16, and the bottom plate 34 are independently molded units. Note, however, that the lower plate 34 could be formed integral to the walls 16, but is illustrated as a separate unit to facilitate the molding operation.

Disposed within the chamber formed between the side walls 16, the cup bottom 20 and the bottom plate 34 is an electronic audio assembly 18 which includes a printed circuit board (PCB) 38 having mounted to its upper surface several electrical and electronic components including an integrated circuit sound chip 40, a plurality of button cell batteries 42, a switching transistor 44, and passive electrical components 46. Affixed to the bottom of circuit board 38 is an actuating switch 48 and a mylar cone speaker 50.

The assembly 18 is a separately assembled unit supported within the chamber by engagement of the relatively rigid outer extremity 52 of the mylar cone speaker component with the annular groove 32 formed in the annulus 28. Switch 48 includes an actuating button 54 which may either extend through an opening in the wall 16 or be placed immediately adjacent a thinned wall portion 56, as indicated.

Once the assembly 18 is complete, it can be installed in the chamber formed by the lower unit 16 by simply aligning button 54 with the thinned wall portion 56 and snapping the speaker cone rim 52 into the annular groove 32. Following attachment of plate 34 to the bottom of part 16, the lower assembly is complete, and the upper cup portion 12 may be snapped into engagement therein by forcing the annular rib 24 into the mating groove 26 to complete the device assembly.

As suggested by the illustration at 60, at least the upper part of the unit 10 is decorated to display a memorable event such as an outstanding football run, or touchdown, or perhaps a pass catch, an outstanding baseball play, or other sporting event, and the chip 40 is prerecorded to include a brief replay of an announcer's description of the event as it happened or other corresponding audio clip.

The cup assembly 10 thus may be used to implement several functions, e.g.: (1) to provide a container for liquids such as beer, cola, juices, water, etc.; (2) to provide a visual remembrance of a particular sporting or other event such as a wedding, birthday party, a retirement party, radio or TV show, etc.; and (3) to provide an audio playback describing the event as it occurred in real time, thereby allowing the user to perhaps mentally relive the experience of the actual event.

Figure 2:
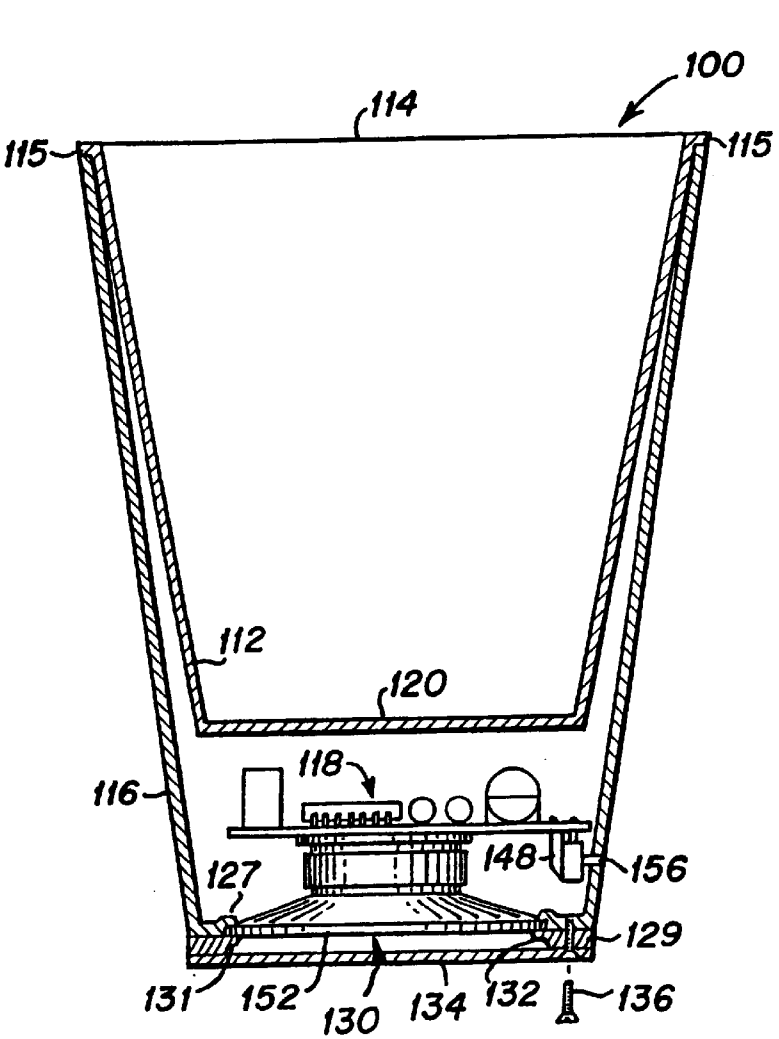
FIG. 2 is a cross-sectional view taken through an alternative embodiment of the present invention.

Turning now to FIG. 2 of the drawing, an alternative embodiment is illustrated at 100 which is functionally similar to the previously described embodiment and differs therefrom only in its details of construction. This configuration includes an inner, cup-forming, frusto-conically configured part 112 nested within an outer frusto-conically configured second component 116 which is open at the bottom, as indicated at 130. The opening 130 is closed by a circular plate 134 that is positioned in spaced-apart relation to the bottom of component 116 by an annular ring 129, both parts being affixed to component 116 by means of a plurality of mounting screws 136, or the like.

The unit includes an audio assembly 118 substantially identical to that described above and disposed beneath the inner cup bottom 120 and the bottom plate 134. As in the previous embodiment, the outer perimeter of the speaker cone 152 is captured within a groove 132 formed by the inner annulus 127 of component 116 and the inner annulus 131 of ring 129.

In this embodiment, the assembly 118 is preferably installed from the bottom prior to installation of ring 129 and plate 134. The inner component 112 may be attached to the outer component 116 at the upper extremities 114 and 115, respectively, either before or after the assembly 118 is installed. Cup lips 114 and 115 can be secured to each other by use of an appropriate solvent, glue, heat-sealing or ultrasonic bonding technique, or the like.

Operation of this embodiment is substantially identical to that previously described in that switch 148 may be actuated through a thinned wall portion 156 of the outer component 116. Similarly, an appropriate graphic depiction of an event may be suitably applied to the outer surface of component 116.

Figure 3:
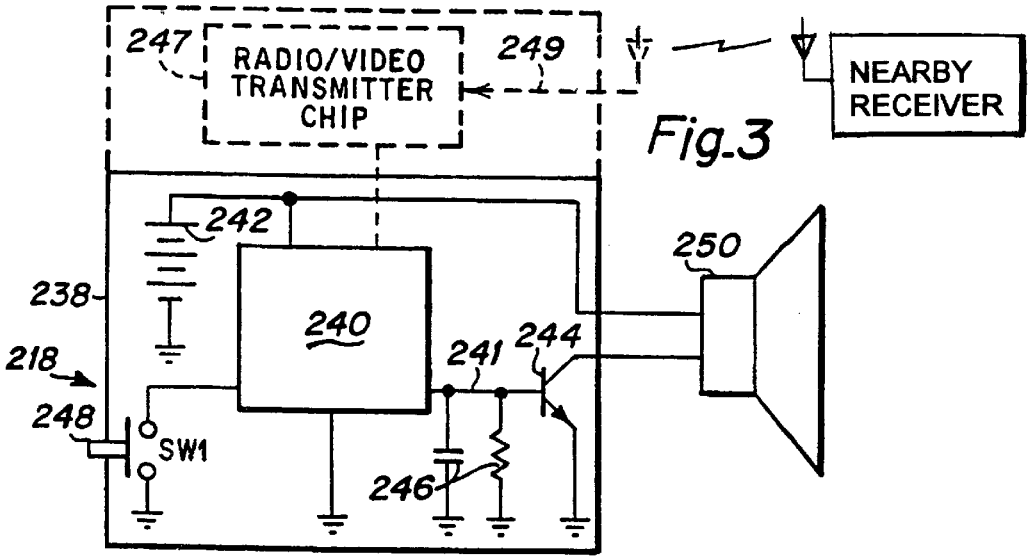
FIG. 3 is a simplified electrical schematic illustrating the audio circuit included in the illustrated embodiments.

Turning now to FIG. 3 of the drawing, the audio subsystem is depicted in schematic detail at 218 and includes a printed circuit board 238 having mounted to the upper surface thereof a suitable electronic data chip, such as the WINBOND W52909 Speech Chip 240, a plurality of button cell batteries 242, a switching transistor 244, passive circuit elements 246, and a switch 248. A speaker 250 is suitably affixed to the bottom of board 238 by means not shown.

In an alternative embodiment suggested by the dashed lines in FIG. 3, lower component 218 may also include a low power radio/video transmitter 247 for transmitting audio/video signals to a nearby radio or television receiver. The transmitter would be embodied in additional electronic components adapted to receive output from the sound/data generating chip 240 and to upshift stored sound and/or video signals to a frequency suitable for wireless transmission via a suitable antenna 249 to a nearby AM, FM or television receiver or the like.

In operation, current is caused to flow from batteries 242 through speaker 250 under control of the transistor 244 which is itself controlled by speech chip 240. Chip 240 is actuated by switch 248 and will generate a digital output on line 241 that will control actuation of transistor amplifier 244, thereby modulating current flow through speaker 250 in accordance with the data stored in chip 240. Digital noise is filtered by the resistive and capacitive components 246. Although other sound-generating circuits can be used, this simple circuitry is presently preferred.

Figure 4:
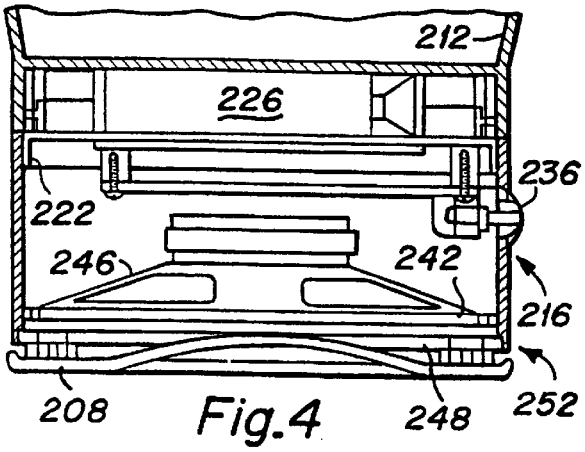
FIG. 4 is a cross-sectional view showing an alternative configuration of the lower component in what Applicant refers to as a "hockey puck" configuration.
Figure 5:
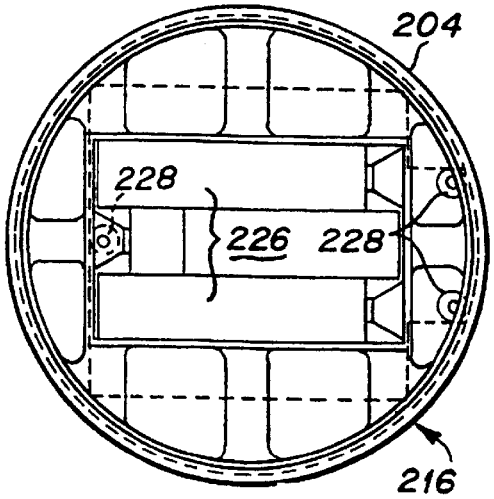
FIG. 5 is a top plan view showing the top of the lower component.
Figure 6:
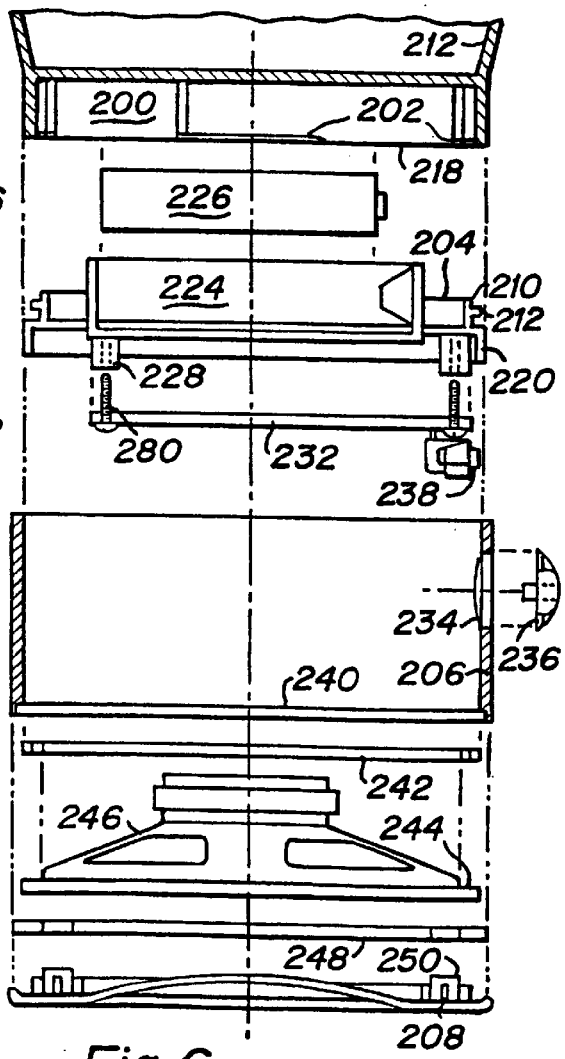
FIG. 6 is an exploded view showing the several elements of the lower component.

Turning now to FIGS. 4, 5 and 6, an alternative embodiment of the lower component is shown at 216 for attachment to an alternative cup component, the bottom of which is shown at 212. As indicated in FIGS. 4 and 6, the cup bottom includes a circular receptacle 200 open toward the bottom and having inwardly extending, accurately configured ridges 202 formed at the lower extremity. The ridges 202 each subtend an arc of less than 90° and are tapered at one extremity for reasons which will be explained below.

The lower component 216 includes a housing made of a bezel 204 (FIG. 6), a cylindrical sleeve 206, and a bottom plate 208. The bezel 204 includes an upstanding annulus 210 having a segmented circumscribing ridge or lip 214, each segment of which in intended to slide into a space 218 in cup cavity 200, such that when so inserted and the bezel is rotated relative to the cup, the ridges 214 cam up and onto the upper surfaces of ridges 202 and form a locking engagement between the bezel and the cup. Bezel 204 also has a down-turned skirt 220 with an outer diameter equal to the inner diameter of sleeve 206 and adapted to be force fit into sleeve 206, as indicated at 222 in FIG. 4, forming a mating engagement between the bezel and the sleeve. Bezel 204 further includes a rectangular shaped receptacle 224 centrally located upon its upper surface for receiving three AAA size batteries 226.

Depending from the bottom surface of bezel 204 are three downwardly depending standoffs 228 which receive screws 230 used to secure a PC board 232 to the bezel. Mounted to the upper side of board 232 are the various electrical and electronic elements forming the operative signal generating components of the device as depicted in FIG. 1.

Sleeve 206 includes an opening 234 in one side thereof for receiving an actuating button 236 which mates with, and is used to actuate a switch 238 carried by circuit board 232. Sleeve 206 also has an internal chamfer 240 formed at its lower extremity. A slightly oversized resilient ring 242 is forced into sleeve 206, as indicated in FIG. 4, to form a stop for the upper flange 244 of a speaker 246, and a lower O-ring 248 engages chamfer 240 and is bonded thereto to complete the capture of speaker flange 244.

Upwardly extending standoffs 250 on plate 208 engage and are bonded to O-ring 248 and the space between plate 208 and sleeve 206 defines an annular sound emitting window or passageway 252, as indicated in FIG. 4. Note that the interior of plate 208 is domed so as to cooperate with speaker 246 to direct outwardly the sound developed thereby . . . .

Although not shown in FIGS. 4–6 for clarity, board 232 carries electrical and electronic elements, the type illustrated in FIG. 3, and upon actuation of the button 236, switch 238 is closed causing the circuit to cycle and generate a playback of electronically stored data, information, and/or music digitally contained within the semiconductor devices carried by board 232.

Whereas the present invention has been described above in terms of specific embodiments, it is anticipated that alterations and modifications thereof will no doubt become apparent to those skilled in the art. For example, the plastic components forming the cup assembly may be comprised of a unitary molded part having a cavity for receiving a self-contained and sealed audio subsystem. Furthermore, the assembly may include a cap or other means for closing the liquid-containing chamber. It is therefore intended that the following claims be interpreted as covering all such alterations and modifications as fall within the true spirit and scope of the invention.

What is claimed is:

1. A fluid drinking vessel, including means for providing audio and visual remembrances of a previous event, comprising:

pre-recorded signal generating means which upon activation, outputs a predetermined audio message, said signal generating means including an integrated circuit chip for storing electronic data and outputting electrical signals corresponding to said data, a power supply, and an audio sound generator responsive to said electrical signals and operative to generate said audio message;

housing means forming a chamber containing said signal generating means, said housing means being generally cylindrical and having an annular opening formed therein at least partially circumscribing said chamber and forming a sound communicating passageway between said chamber and the ambient environment outside said housing means, said housing means further including sound deflecting means for directing the audio output from said sound generator through said annular opening; and means forming a cup adapted to contain a drinkable liquid, said cup forming means being associated with said housing means such that said chamber is disposed adjacent and beneath the bottom of said cup, said cup forming means having an exterior surface upon which pictorial subject matter corresponding to said audio message is affixed.

2. A fluid drinking vessel as recited in claim 1 wherein said signal generating means further includes amplifier means for amplifying said electrical signals to a level suitable to drive said audio sound generator.

3. A fluid drinking vessel as recited in claim 1 wherein said cup forming means includes a first container defining a first volume of space, and said housing means includes a second container defining a second volume of space greater than said first volume and including the space occupied by said chamber, and wherein said first container is disposed within said second volume of space and forms a closure defining the upper limits of said chamber.

4. A fluid drinking vessel as recited in claim 3 wherein said housing means is defined by opposing parts of said first and second containers, with said chamber being disposed therebetween.

5. A fluid drinking vessel as recited in claim 4 wherein said first and second containers have portions forming corresponding openings, said portions being joined together to unite said first and second containers.

6. A fluid drinking vessel as recited in claim 1 wherein said housing means is separate from said cup forming means and wherein said housing means and said cup forming means each have mating attachment means for securing one to the other.

7. A fluid drinking vessel as recited in claim 1 wherein said signal generating means further includes a low powered transmitter and associated antenna for wireless transmission of said audio message to a nearby radio receiver.

8. A fluid drinking container as recited in claim 7 wherein said signal generating means further stores and outputs video data for transmission to a nearby television receiver.

9. A fluid drinking vessel as recited in claim 1 wherein said housing means is generally cylindrical in configuration and said annular opening through which said audio message is communicated is disposed proximate a bottom surface of said housing means.

10. A device for providing audio and visual information relating to an event, comprising:

means for storing a pre-recorded audio message;

a signal generator which upon activation outputs said audio message, said signal generator including an integrated circuit chip for storing electronic data and outputting electrical signals corresponding to said data, a power supply, an audio sound generator responsive to said electrical signals and operative to generate said audio message, and sound directing means; and a container including first means forming a first cavity for containing comestible material, and second means forming a second cavity for containing said message storing means and said signal generator, said second means having an exterior surface for displaying textual, pictorial or graphical subject matter corresponding to said audio message, said container having a bottom surface surrounded by a continuous side wall, said side wall having laterally opening port means extending therethrough, said sound directing means for communicating said audio message from said second cavity through said laterally opening port means to the surrounding ambient environment.

11. A device as recited in claim 10 wherein said audio generator further includes amplifier means for amplifying said electrical signals to a level suitable to drive said audio generator.

12. A device as recited in claim 10 wherein said container includes a first vessel defining said first cavity, and a second vessel defining said second cavity, said second cavity being larger than said first cavity and said first vessel being disposed within said second cavity.

13. A device as recited in claim 12 wherein said signal generator is disposed within said second cavity between said first and second vessels.

14. A device as recited in claim 13 wherein said first and second vessels have portions forming corresponding openings, said portions being joined together to unite said first and second vessels.

15. A device as recited in claim 12 wherein said second vessel is generally cylindrical in configuration and said laterally opening port means includes an annular opening, and wherein said sound directing means is associated with said bottom surface and is configured to direct sound from said signal generator through said port means for emitting sound waves generated by said signal generator.

16. A device as recited in claim 15 wherein said means associated with said bottom surface is a sound reflector having a shape selected from the group consisting of dome-shaped, conically shaped, bell shaped and polygonically shaped.

17. A device as recited in claim 10 wherein said first and second means have mating means for securing one to the other.

18. A device as recited in claim 10 wherein said signal generator includes a low power transmitter and associated antenna for wireless transmission of said audio message to a nearby radio receiver.

19. A fluid drinking vessel, including means for providing audio and visual remembrances of a previous event, comprising:

pre-recorded signal generating means which upon activation, outputs a predetermined audio message, said signal generating means further including a low powered transmitter and associated antenna for wireless transmission of said audio message to a nearby radio receiver;

housing means forming a chamber containing said signal generating means, said housing means having an annular opening formed therein at least partially circumscribing said chamber and forming a sound communicating passageway between said chamber and the ambient environment outside said housing means; and means forming a cup adapted to contain a drinkable liquid, said cup forming means being associated with said housing means such that said chamber is disposed adjacent and beneath the bottom of said cup, said cup forming means having an exterior surface upon which pictorial subject matter corresponding to said audio message is affixed.

20. A fluid drinking container as recited in claim 19 wherein said signal generating means further stores and outputs video data for transmission to a nearby television receiver.

21. A device for providing audio and visual information relating to an event, comprising:

means for storing a pre-recorded audio message;

a signal generator which upon activation outputs said audio message, said signal generator including a low power transmitter and associated antenna for wireless transmission of said audio message to a nearby radio receiver; and a container including means forming a first cavity for containing comestible material, and a second cavity for containing said message storing means and said signal generator, said last named means having an exterior surface for displaying textual, pictorial or graphical subject matter corresponding to said audio message, said container having a bottom surface surrounded by a continuous side wall, said side wall having laterally opening port means for communicating said audio message from said second cavity to the surrounding ambient environment.

* * * * *